US008934810B2

(12) United States Patent
Ishino et al.

(10) Patent No.: US 8,934,810 B2
(45) Date of Patent: Jan. 13, 2015

(54) IMAGE FORMING APPARATUS, IMAGE FORMING STRUCTURE BODY AND ATTACHMENT METHOD

(75) Inventors: Masahiro Ishino, Saitama (JP); Hidekazu Amamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 464 days.

(21) Appl. No.: 12/509,761

(22) Filed: Jul. 27, 2009

(65) Prior Publication Data

US 2010/0247195 A1 Sep. 30, 2010

(30) Foreign Application Priority Data

Mar. 27, 2009 (JP) ..... 2009-080649

(51) Int. Cl.
*G03G 15/00* (2006.01)
*B41J 29/02* (2006.01)
*G03G 21/18* (2006.01)

(52) U.S. Cl.
CPC .... *G03G 21/181* (2013.01); *G03G 2215/00016* (2013.01)
USPC ..... 399/110; 399/107; 400/691; 400/692; 400/693

(58) Field of Classification Search
CPC ..... G03G 21/1604; G03G 21/181; G03G 21/1609; G03G 21/1619; G03G 2221/16; G03G 2221/1651; G03G 2221/1678; G03G 2221/1696; B54H 2402/10
USPC ..... 399/81, 107, 108, 110, 381; 400/691, 400/692, 693
See application file for complete search history.

(56) References Cited

U.S. PATENT DOCUMENTS

| | | | | |
|---|---|---|---|---|
| 5,208,612 | A | 5/1993 | Obu et al. | |
| 6,308,027 | B1 * | 10/2001 | Obu et al. | 399/110 |
| 6,314,254 | B1 * | 11/2001 | Wakahara | 399/81 |
| 6,674,982 | B2 | 1/2004 | Saitoh et al. | 399/110 |
| 6,708,011 | B2 | 3/2004 | Nomura et al. | 399/110 |
| 6,836,628 | B2 | 12/2004 | Funakoshi | 399/88 |
| 6,925,283 | B1 | 8/2005 | Mandel et al. | 399/388 |

(Continued)

FOREIGN PATENT DOCUMENTS

| | | |
|---|---|---|
| JP | 04-118271 | 4/1992 |
| JP | 05-313428 | 11/1993 |

(Continued)

*Primary Examiner* — Daniel J Colilla
*Assistant Examiner* — Justin Olamit
(74) *Attorney, Agent, or Firm* — Morgan, Lewis & Bockius LLP

(57) ABSTRACT

The image forming apparatus is provided with: a replaceable image forming structure body including elements for image formation; a recording medium transporting structure body including elements for transporting a recording medium to the image forming structure body; an output recording medium transporting structure body transporting, to an output port, a recording medium outputted from the image forming structure body; and a connection structure body electrically connected to structure bodies. They each form at least a part of the appearance of the image forming apparatus. The latter three bodies are adjacent to each other, and attachable in a state where the image forming structure body is not attached, the image forming structure body is in contact with at least three surfaces included in surfaces of the other bodies adjacent to each other, and the image forming structure body is attachable in a state where the other bodies have been attached.

12 Claims, 10 Drawing Sheets

(56) References Cited

U.S. PATENT DOCUMENTS

| | | | | |
|---|---|---|---|---|
| 6,959,165 | B2 | 10/2005 | Mandel et al. | 399/391 |
| 6,973,286 | B2 | 12/2005 | Mandel et al. | 399/391 |
| 7,082,274 | B2 | 7/2006 | Saitoh et al. | 399/110 |
| 7,184,681 | B2 | 2/2007 | Funakoshi | 399/88 |
| 7,515,288 | B2 | 4/2009 | Nomura et al. | 358/1.15 |
| 7,761,029 | B2 | 7/2010 | Nojima | 399/107 |
| 2002/0037178 | A1 | 3/2002 | Saitoh et al. | 399/110 |
| 2002/0145770 | A1 | 10/2002 | Nomura et al. | 358/505 |
| 2003/0053819 | A1 | 3/2003 | Nomura et al. | 399/110 |
| 2004/0005166 | A1 | 1/2004 | Funakoshi | 399/88 |
| 2005/0002686 | A1 | 1/2005 | Saitoh et al. | 399/110 |
| 2005/0025515 | A1 | 2/2005 | Funakoshi | 399/88 |
| 2005/0158094 | A1 | 7/2005 | Mandel et al. | 399/391 |
| 2005/0158097 | A1 | 7/2005 | Mandel et al. | 399/407 |
| 2005/0158098 | A1 | 7/2005 | Mandel et al. | 399/407 |
| 2007/0053021 | A1 | 3/2007 | Osari et al. | |
| 2007/0053715 | A1 | 3/2007 | Kawase et al. | |
| 2007/0070430 | A1 | 3/2007 | Nojima | 358/296 |

FOREIGN PATENT DOCUMENTS

| | | | | | |
|---|---|---|---|---|---|
| JP | 06-035248 | | 2/1994 | | |
| JP | 2788312 | B | 6/1998 | | |
| JP | 10-193747 | | 7/1998 | | |
| JP | 11216931 | A | * | 8/1999 | B41J 29/00 |
| JP | 3034269 | B | 2/2000 | | |
| JP | 3064358 | B | 5/2000 | | |
| JP | 2000-310930 | | 11/2000 | | |
| JP | 2001-125332 | | 5/2001 | | |
| JP | 2001-219618 | | 8/2001 | | |
| JP | 3288639 | B | 3/2002 | | |
| JP | 2002-108170 | | 4/2002 | | |
| JP | 2002-244529 | | 8/2002 | | |
| JP | 2002-305620 | | 10/2002 | | |
| JP | 2003-076106 | | 3/2003 | | |
| JP | 2004-037942 | | 2/2004 | | |
| JP | 2004-209745 | | 7/2004 | | |
| JP | 2005-205911 | | 8/2005 | | |
| JP | 2006-251361 | | 9/2006 | | |
| JP | 3901479 | B | 1/2007 | | |
| JP | 2007-078768 | | 3/2007 | | |
| JP | 2007-102187 | | 4/2007 | | |
| JP | 2007-102188 | | 4/2007 | | |
| JP | 2008-180883 | | 8/2008 | | |

* cited by examiner

IMAGE FORMING APPARATUS, IMAGE FORMING STRUCTURE BODY AND ATTACHMENT METHOD

CROSS REFERENCE TO RELATED APPLICATIONS

This application is based on and claims priority under 35 USC §119 from Japanese Patent Application No. 2009-80649 filed Mar. 27, 2009.

BACKGROUND

1. Technical Field

The present invention relates to an image forming apparatus, an image forming structure body and an attachment method.

2. Related Art

Conventional image forming apparatuses have been designed in consideration of merchantability in apparatus configuration, accessory configuration and the like so that a majority of users would use the image forming apparatuses in optimum states. For this reason, such image forming apparatuses have not been configured to flexibly meet individual and particular user demands.

SUMMARY

According to an aspect of the present invention, there is provided an image forming apparatus including: an image forming structure body that is replaceable, that forms at least a part of appearance of the image forming apparatus, and that includes elements for image formation; a recording medium transporting structure body that forms at least a part of the appearance of the image forming apparatus, and that includes elements for transporting a recording medium to the image forming structure body; an output recording medium transporting structure body that forms at least a part of the appearance of the image forming apparatus, and that transports, to an output port, a recording medium outputted from the image forming structure body; and a connection structure body that forms at least a part of the appearance of the image forming apparatus, and that is electrically connected to structure bodies. The recording medium transporting structure body, the output recording medium transporting structure body and the connection structure body is adjacent to each other, and is attachable to each other in a state where the image forming structure body is not attached, and the image forming structure body is in contact with at least three surfaces included in surfaces of the recording medium transporting structure body, the output recording medium transporting structure body and the connection structure body, the surfaces being adjacent to each other, and the image forming structure body is attachable in a state where the recording medium transporting structure body, the output recording medium transporting structure body and the connection structure body have been attached to each other.

BRIEF DESCRIPTION OF THE DRAWINGS

Exemplary embodiment(s) of the present invention will be described in detail based on the following figures, wherein.

DETAILED DESCRIPTION

An exemplary embodiment of the present invention will be described below in detail with reference to the accompanying drawings.

<Description of Entire Image Forming Apparatus>

Figure 1:
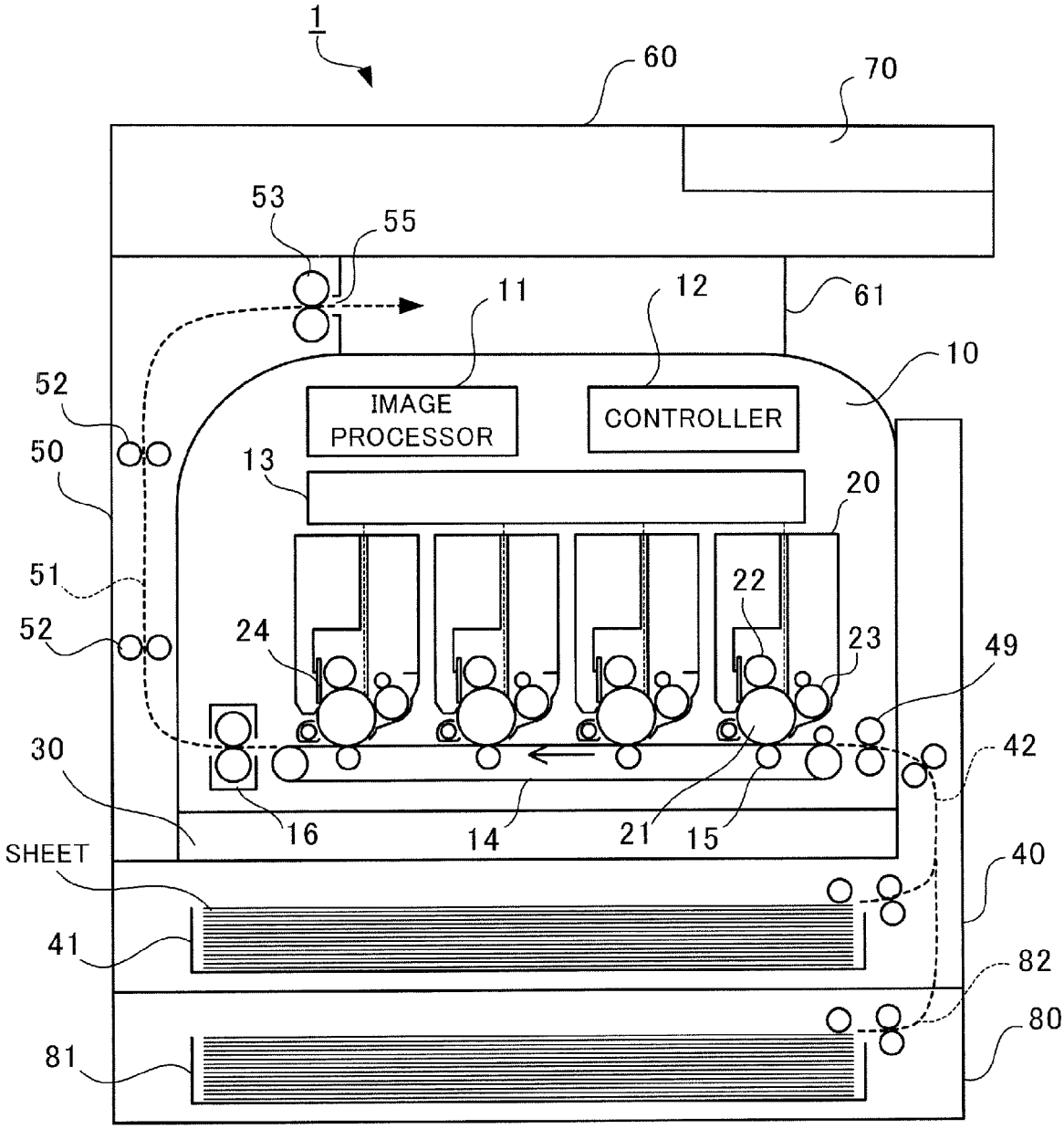
FIG. 1 is a view showing a configuration example of an image forming apparatus to which the exemplary embodiment is applied.
Figure 2A:
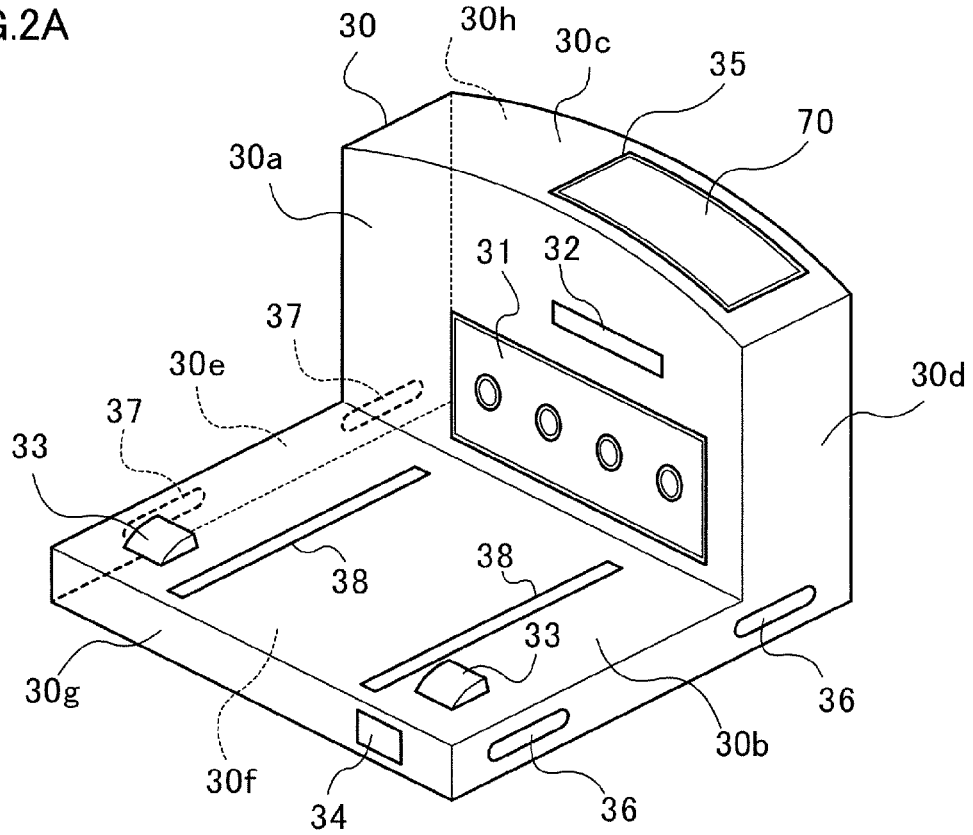
FIGS. 2A and 2B are views for illustrating the power supply unit and a state in which the image forming unit is attached to the power supply unit, respectively.
Figure 2B:
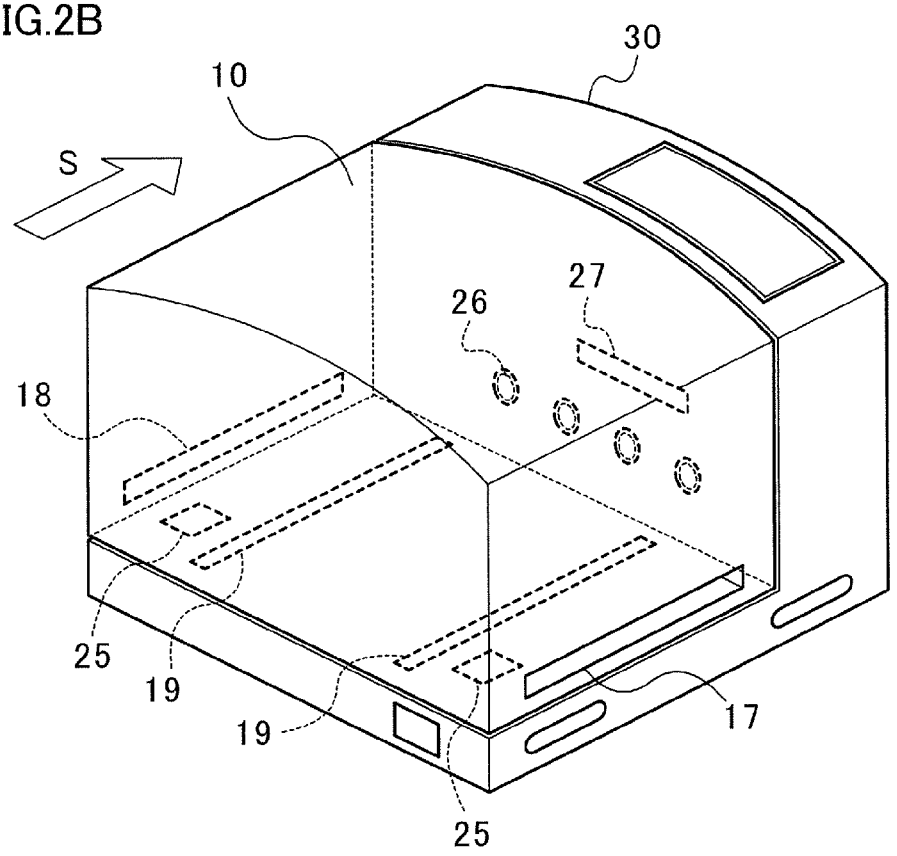

FIG. 1 is a view showing a configuration example of an image forming apparatus 1 to which the exemplary embodiment is applied. The image forming apparatus 1 shown in FIG. 1 includes: an image forming unit 10 as an example of an image forming structure body that has a functional component for carrying out image formation in actual; and a power supply unit 30 as an example of a first external structure body, or a connection structure body that either supplies power to each structure body or has a control function for each structure body, or both. The image forming apparatus 1 also includes: a feeding unit 40 as an example of a second external structure body, or a recording medium transporting structure body that transports sheets used as recording media to the image forming unit 10; and an output unit 50 as an example of a third external structure body, or an output recording medium transporting structure body that transports and outputs sheets subjected to image formation. Further, the image forming apparatus 1 includes: a capturing unit 60 as an example of an image capturing structure body that captures originals; an operation unit 70 as an example of a user operation structure body that has a so-called control panel and receives operations made by a user; and an additional feeding unit 80 as an example of an additional feeding structure body that is additionally attachable to the feeding unit 40, and that feeds and then transports sheets. The image forming unit 10, the power supply unit 30, the feeding unit 40, the output unit 50, the capturing unit 60, the operation unit 70 and the additional feeding unit 80, which are examples of the above-described structure bodies, each form at least a part of the appearance of the image forming apparatus 1. In the image forming apparatus 1 shown in FIG. 1, the power supply unit 30 is in contact with two surfaces of the image forming unit 10, i.e., a bottom surface thereof and a back surface thereof in FIG. 1, as shown in FIGS. 2A and 2B to be described later.

The image forming apparatus 1 formed of these units (structure bodies) functions as a so-called tandem-type digital color printer, digital color copier, facsimile or the like with electrophotography, for example. As the structure body that carries out image formation in actual, the image forming unit 10 includes an image carrier, an exposure portion, a charging portion, a developing portion, a transfer portion that transfers an image onto a sheet, and a fixing portion that fixes the transferred image to the sheet.

Here, the image forming apparatus 1 is described by taking an image forming apparatus using electrophotography as an example in the present exemplary embodiment. However, an apparatus using a different printing method such as inkjet printing, instead of so-called electrophotography, may also be used. In this case, the image forming unit 10 as an example of the image forming structure body includes a different component required for inkjet printing or the like.

<Description of Image Forming Unit 10>

The image forming unit 10 forms a part of the appearance of the image forming apparatus 1 when being incorporated into the image forming apparatus 1. The image forming unit 10 as a whole is independently merchandised and the appearance of the independently-merchandised image forming unit 10 forms a part of the appearance of the image forming apparatus 1, into which the image forming unit 10 is incorporated.

The image forming unit 10 includes: multiple image forming portions 20 that are provided for respective colors and carry out image formation; an image processor 11 that carries out image processing on image data received from the power supply unit 30, for example; and a controller 12 that controls operations of the image forming unit 10. The image forming unit 10 also includes a laser exposure device 13 as an exposure portion that performs an exposure operation for each of the multiple image forming portions 20 on the basis of the image data of the corresponding color. The image forming portions 20 each include: a photoconductive drum 21 as an image carrier, a charging roller 22 as a charging portion, a developing device 23 as a developing portion, and a drum cleaner 24. The charging roller 22 uniformly charges a surface of the photoconductive drum 21 at a predetermined potential. The developing device 23 of each of the image forming portions 20 holds a two-component developer composed of magnetic carrier and a corresponding color toner of yellow (Y), magenta (M), cyan (C) or black (K), for example, and develops an electrostatic latent image on the photoconductive drum 21 by using the corresponding color toner. The drum cleaner 24 causes, for example, a plate-like member to come in contact with the surface of the photoconductive drum 21, and thereby removes toner, paper dust and the like adhering to the photoconductive drum 21.

The image forming unit 10 includes the laser exposure device 13 as an example of a scanning optical device that exposes the photoconductive drum 21 provided to each of the image forming portions 20. The laser exposure device 13 acquires image data of each color from the image processor 11, and then performs scan exposure on the photoconductive drum 21 of each of the image forming portions 20 by using a laser beam whose lighting is controlled on the basis of the acquired image data. Moreover, the image forming unit 10 also includes a sheet transporting belt 14 that transports a sheet so that the sheet moves while being in contact with the photoconductive drums 21 of the image forming portions 20. The sheet transporting belt 14 is formed of a film-like endless belt that electrostatically adsorbs the sheet. At each of positions on an inner side of the sheet transporting belt 14 and respectively facing the photoconductive drums 21, a transfer roller 15 is provided. The transfer rollers 15 each form a transfer electric field between itself and the corresponding photoconductive drum 21, and sequentially transfer, to the sheets, toner images of the respective colors formed in the image forming portions 20. Further, aligning rollers 49 are provided on the upstream side of the sheet transporting belt 14 in a sheet transporting direction, and send out a sheet toward the image forming portions 20 at a suitable timing. A fixing device 16 is provided on the downstream side of the sheet transporting belt 14 in the sheet transporting direction, and performs a fixing process using heat and pressure on an unfixed toner image on the sheet.

As described above, the image forming unit 10 includes major image forming components essential for image formation, such as components of the image forming portions 20 including the image carrier, the charging portion, the exposure portion, the developing portion, the transfer portion and the cleaning portion, and toners before use, toners after use and a sheet transporting portion.

The image forming unit 10 including these components is configured to be replaceable as a single unit. In other words, the image forming portions 20 are not individually detached or attached. For example, if any of the image forming portions 20 uses up a toner to be supplied to the developing device 23 and thereby loses the ability to form images, the image forming unit 10 is replaced with a new image forming unit 10 by pulling out the entire old image forming unit 10 and then attaching the entire new image forming unit 10.

In the example shown in FIG. 1, four image forming portions 20 for the respective colors of yellow (Y), magenta (M), cyan (C) and black (K) are provided. Another example is to provide five image forming portions 20 including an image forming portion 20 for printing of a special color such as a corporate color besides the four image forming portions 20. Still another example is to provide five image forming portions 20 in total including two black (K) engines to reinforce the function for black (K). Alternatively, engines for a single color, instead of multiple colors, may be used. In such a case, only a single image forming portion 20 may be used. An image forming unit 10 including these components may be prepared as a replacement unit. Further, as the image forming unit 10, an example of including none of the image processor 11 nor the controller 12 or any one of the image processor 11 and the controller 12 may be employed.

As described above, in the image forming unit 10 to which the present exemplary embodiment is applied, the components from the aligning rollers 49, which is a sheet alignment mechanism for image formation and a mechanism for receiving sheets, to the fixing device 16 are modularized as a single structure body. Moreover, in contrast with a conventional case in which toners, photoconductive drums, developing devices and the like are individually provided as cartridges and are attached to the image forming apparatus 1, the image forming unit 10 to which the present exemplary embodiment is applied does not employ the cartridge system. Further, for each of the components forming the image forming unit 10, accurate jig assembly is employed for example, and a so-called black box is used so as not to reveal the internal configuration to a user. The image forming portions 20 may be five-tandem type, instead of four-tandem type. As the five-tandem type, one example may be selected among: an example of using five engines (image forming portions 20) for the K color; an example of further adding an engine for K to the engines for Y, M, C and K; and an example of adding an engine for a special color to the engines for Y, M, C and K. Any ones of the above-described image forming units 10 having different engines may be incorporated therein. The image forming unit 10 having such a configuration restricts a user from opening and closing portions inside the apparatus, and hence the operation allowed for the user is limited to input and output of sheet transportation, mechanical alignment and electrical coupling, for example.

<Description of Power Supply Unit 30>

As a main function, the power supply unit 30 supplies power to each of the constituent units (the image forming unit 10, the feeding unit 40, the output unit 50, the capturing unit 60, the operation unit 70 and the additional feeding unit 80). The appearance of the power supply unit 30 is shown in detail in FIG. 2A to be described later. The power supply unit 30 generates desired supply voltage by using a commercial power source, and then supplies power to a drive system of each of the constituent units. Accordingly, the power supply unit 30 includes: a low supply voltage supplying portion that generates low supply voltage (approximately 24 V) for rotating the photoconductive drums 21 and the like; and a high supply voltage supplying portion that generates high supply voltage (several KV). The power supply unit 30 supplies power to each of the constituent units through a connector (not shown in the figure), which is a wiring portion. The wiring portions may be configured so as to be electrically connected to the constituent units upon incorporation of the constituent units, for example.

Further, the power supply unit 30 also includes an electric circuit that edits and stores image data acquired, for example, from a personal computer (PC) not shown in the figure or the capturing unit 60, and performs image processing based on the image data to be transferred to the image forming unit 10. When the image forming unit 10 includes neither the image processor 11 nor the controller 12 as described above, the power supply unit 30 is provided with these functions restrained (excluded) in the image forming unit 10.

The power supply unit 30 includes drive sources such as drive motors that respectively drive the components of the image forming unit 10. In this case, the image forming unit 10 is not provided with such various drive sources. By attaching the image forming unit 10 to the power supply unit 30, the drive source of the power supply unit 30 and each of the components of the image forming unit 10 are coupled. This coupling allows the power supply unit 30 to drive the components of the image forming unit 10. For example, the components are coupled with the drive sources of the power supply unit 30 at the photoconductive drums 21 and mechanical members around the photoconductive drums 21, for example, by using couplings which are joints using mechanisms such as ball joints. Alternatively, the components are, individually or in groups, coupled with the drive sources of the power supply unit 30 at drive positions of the sheet transporting belt 14, the various sheet transporting rollers and the like, by using couplings. Thus, no mechanical drive source is provided in the image forming unit 10, which limits the number of components of the replaceable image forming unit 10.

Further, in the present exemplary embodiment, the power supply unit 30 forms a part of the appearance of the image forming apparatus 1. Moreover, the power supply unit 30 serves as a base when the feeding unit 40, the output unit 50 and the capturing unit 60 are attached thereto. In addition, the power supply unit 30 may also serve as a base when the image forming unit 10 is attached thereto. Here, the operation unit 70 shown in FIG. 1 is attached to the capturing unit 60. However, for example, when the image forming apparatus 1 is not provided with the capturing unit 60, the operation unit 70 is attached to the power supply unit 30 (see FIG. 4) as will be described later. Further configuration examples of the power supply unit 30 will be described in detail in description of FIGS. 2A and 2B to be given later.

<Description of Feeding Unit 40>

The feeding unit 40 transports a sheet toward the image forming unit 10. In the example shown in FIG. 1, the feeding unit 40 is in contact with an outer bottom surface of the power supply unit 30, and transports a sheet from one side of the image forming unit 10 toward the image forming unit 10. The feeding unit 40 includes various rollers and the like for the feeding, separating and transporting sheets. When incorporated into the image forming apparatus 1, the feeding unit 40 forms a part of the appearance of the image forming apparatus 1, and, as shown in FIG. 1, is in contact with at least one side surface of the image forming unit 10 to thereby cover the one side surface of the image forming unit 10. Here, to form the feeding unit 40 so as to include only essential component parts, the feeding unit 40 may be in contact with only a part of the one side surface of the image forming unit 10, for example, a part of the side surface up to the height of an approximately middle of the image forming unit 10, instead of entirely covering the side surface. The feeding unit 40 includes: a sheet storing portion 41 that stores sheets serving as recording media; and a transporting path 42 through which a sheet sent out from the sheet storing portion 41 is transported toward the image forming unit 10. When the image forming unit 10 is incorporated into the image forming apparatus 1, a sheet output port, continuous from the transporting path 42, of the feeding unit 40 is aligned with a sheet receiving port of the image forming unit 10, thus forming a transporting path.

<Description of Output Unit 50>

The output unit 50 receives a sheet having thereon an image formed in the image forming unit 10, and then transports the sheet toward an output port 55. When incorporated into the image forming apparatus 1, the output unit 50 forms a part of the appearance of the image forming apparatus 1, and is in contact with the other side surface (assuming the side surface in contact with the feeding unit 40 as the one side surface) of the image forming unit 10 to thereby cover the other side surface of the image forming unit 10 as shown in FIG. 1. In other words, the output unit 50 has a case structure extending upward from the bottom, on the other side surface of the image forming unit 10. The output unit 50 includes: a transporting path 51 that transports the sheet having thereon the image formed in the image forming unit 10; and multiple pairs of transporting rollers 52 that are provided on the transporting path 51 and transport the sheet. Moreover, the output unit 50 also includes: the output port 55 that outputs the sheet having thereon the image printed in the image forming unit 10; and output rollers 53 that output the sheet from the output port 55. In the present exemplary embodiment, a top part (top surface) of the case structure of the image forming unit 10 serves as an exit tray on which the outputted sheet is stacked.

<Description of Capturing Unit 60>

The capturing unit 60 functions as an image capturing device that captures an image lying on an original such as a sheet material, for example. When incorporated into the image forming apparatus 1, the capturing unit 60 forms a part of the appearance of the image forming apparatus 1. In this system structure additionally including the capturing unit 60, the operation unit 70 is attached to a part of the capturing unit 60. The capturing unit 60 may have a structure including an original transporting device that transports a sheet-like original. In addition, the capturing unit 60 may have a scanning structure in which an original having a thickness such as a book is placed on a plane glass (platen glass), and a capturing portion, a lamp, a mirror or the like is caused to scan the original. Alternatively, the capturing unit 60 may have a structure simply as a sheet-original moving type capturing device without having scanning structure. The capturing unit 60 is supported by the power supply unit 30 through a support portion 61, for example, and thereby fixed, and is also supported by the output unit 50. The capturing unit 60 is provided in such a position that a space for the exit tray provided on the top surface of the image forming unit 10 is ensured, and that the operability of the exit tray is not hindered, in other words, a hand of a user may be inserted into the exit tray, for example. Further, the capturing unit 60 is provided in such a position that, even when performing a replacement operation of the image forming unit 10 or the like, the user is allowed to perform the operation while holding the top surface of the image forming unit 10.

<Description of Operation Unit 70>

When incorporated into the image forming apparatus 1, the operation unit 70 forms a part of the appearance of the image forming apparatus 1. When the image forming apparatus 1 has a structure of including the capturing unit 60 incorporated thereinto, the operation unit 70 is attached to or embedded into the capturing unit 60. When the image forming apparatus 1 is configured without the capturing unit 60, the operation unit 70 is incorporated into the power supply unit 30, for example.

<Description of Additional Feeding Unit 80>

When incorporated into the image forming apparatus 1, the additional feeding unit 80 forms a part of the appearance of the image forming apparatus 1. In the example shown in FIG. 1, the additional feeding unit 80 is in contact with a bottom surface of the feeding unit 40, and forms: the appearance of the bottom surface of the image forming apparatus 1; and the appearance of side surfaces, continuous from the bottom surface, of the image forming apparatus 1. The additional feeding unit 80 includes a sheet storing portion 81 that stores sheets serving as recording media; and a transporting path 82 that transports a sheet sent out from the sheet storing portion 81 toward the feeding unit 40. The additional feeding unit 80 also includes various rollers for feeding, separating and transporting. The feeding unit 40 includes: a sheet receiving port that receives the sheet fed from the additional feeding unit 80; and a slit-shaped transporting path through which the sheet is transported. The sheet sent out from the sheet storing portion 81 is fed toward the image forming unit 10 through the transporting path 82, and the slit-shaped transporting path and the transporting path 42 of the feeding unit 40.

<Description of Appearance Configuration and Assembly Example of Constituent Units>

Next, an assembly configuration of the constituent units will be described.

FIGS. 2A and 2B are views for illustrating the power supply unit 30 and a state in which the image forming unit 10 is attached to the power supply unit 30, respectively. FIG. 2A shows an appearance of the power supply unit 30, and FIG. 2B shows the state in which the image forming unit 10 is attached to the power supply unit 30.

As shown in FIG. 2A, the power supply unit 30 includes an inner longitudinal surface 30*a*, an inner bottom surface 30*b*, which is an upper surface part, a top surface 30*c*, a one side surface (right side surface) 30*d*, a different side surface (left side surface) 30*e*, an outer bottom surface 30*f*, a one surface (front surface) 30*g* and a different surface (back surface) 30*h*, and also includes, in its case structure, coupling mechanisms respectively for the constituent units to be coupled with the power supply unit 30. More specifically, the power supply unit 30 includes, in the inner longitudinal surface 30*a*: a drive transmission mechanism 31 that transmits drive force to the image forming unit 10; and a connector 32 that forms a signal path to the image forming unit 10. Moreover, the power supply unit 30 includes, in the inner bottom surface 30*b*, a latch structure 33 that mechanically fastens the image forming unit 10 to be attached to the power supply unit 30 and, in the one surface (front surface) 30*g*, a latch button 34 as an unlatch mechanism that unlatches the latch structure 33. Furthermore, the power supply unit 30 includes, in the inner bottom surface 30*b*, a sliding structure mechanism 38 such as a rail mechanism which allows the image forming unit 10 to slide to be incorporated into the image forming apparatus 1.

The power supply unit 30 includes, in the top surface 30*c*, a connection portion 35 that transmits power to and communicates electric signals with the capturing unit 60 or the operation unit 70. In FIG. 2A, the operation unit 70 is incorporated into the connection portion 35. Further, the power supply unit 30 includes, in the one side surface (right side surface) 30*d*, a connector 36 that transmits power to and communicates electric signals with the feeding unit 40, and, in the different side surface (left side surface) 30*e*, a connector 37 that transmits power to and communicates electric signals with the output unit 50.

As shown in FIG. 2B, the image forming unit 10 is coupled with the power supply unit 30, and is thus attached to the image forming apparatus 1. The image forming unit 10 includes, in its bottom surface, a moving mechanism 19 formed of a rail mechanism that is provided so as to correspond to the sliding structure mechanism 38 of the power supply unit 30 and that allows the image forming unit 10 to slide in a sliding direction. Moreover, the image forming unit 10 includes, in the bottom surface, a latch recess 25 that is provided so as to correspond to the latch structure 33 of the power supply unit 30 and that slides. The latch recess 25 aligns and fixes the image forming unit 10 by using the latch structure 33.

The image forming unit 10 also includes, in a one side surface of the case, a sheet receiving port 17 that is provided in a position corresponding to that of the sheet output port of the feeding unit 40 so as to face the sheet output port and that receives sheets from the feeding unit 40. Moreover, the image forming unit 10 includes, in a different side surface of the case, a sheet output port 18 that is provided in a position corresponding to that of the sheet receiving port of the output unit 50 so as to face the sheet receiving port and that outputs sheets toward the output unit 50. In addition, on a side (on a back surface side) that faces the inner longitudinal surface 30*a* of the power supply unit 30 when the image forming unit 10 slides in an attachment direction (arrow S direction) and is thereby attached to the power supply unit 30, the image forming unit 10 includes: a transmission mechanism 26 that is coupled with the drive transmission mechanism 31 of the power supply unit 30; and a connector 27 that is coupled with the connector 32 of the power supply unit 30.

Figure 3:
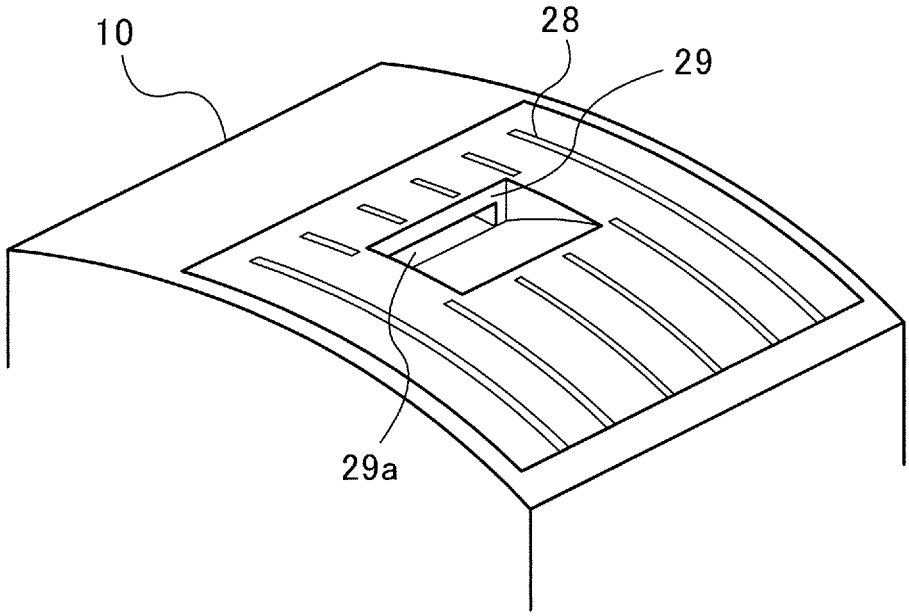
FIG. 3 is a view for illustrating a structure of the exit tray provided in an exterior top surface of the image forming unit.

FIG. 3 is a view for illustrating a structure of the exit tray as an example of an output recording medium tray provided in an exterior top surface, which is an upper surface of the appearance, of the image forming unit 10. On the exterior top surface of the image forming unit 10, ribs 28 are formed along an output direction of the sheets outputted from the output port 55 of the output unit 50 described with reference to FIG. 1. In addition, in a central portion of the exterior top surface, or in such a position that inclination of the image forming unit 10 at the time when the image forming unit 10 is lifted would not hinder the attachment operation (for example, at the center of gravity), a grip 29 as an example of a lifting portion is provided. The grip 29 is formed, for example, as a recess in the exterior top surface, so as not to hinder transporting of the sheets to be outputted. The grip 29 includes a hook portion 29*a* on which fingers of a user are hooked, by using the curved shape of the exterior top surface. Here, the grip 29 may have a structure that is a retractable pop-up type, and that protrudes from the case when an operation is performed to insert or take out the image forming unit 10 while retracting the protruding portion at the time of sheet output.

<Attachment Configuration for Printer>

Figure 4:
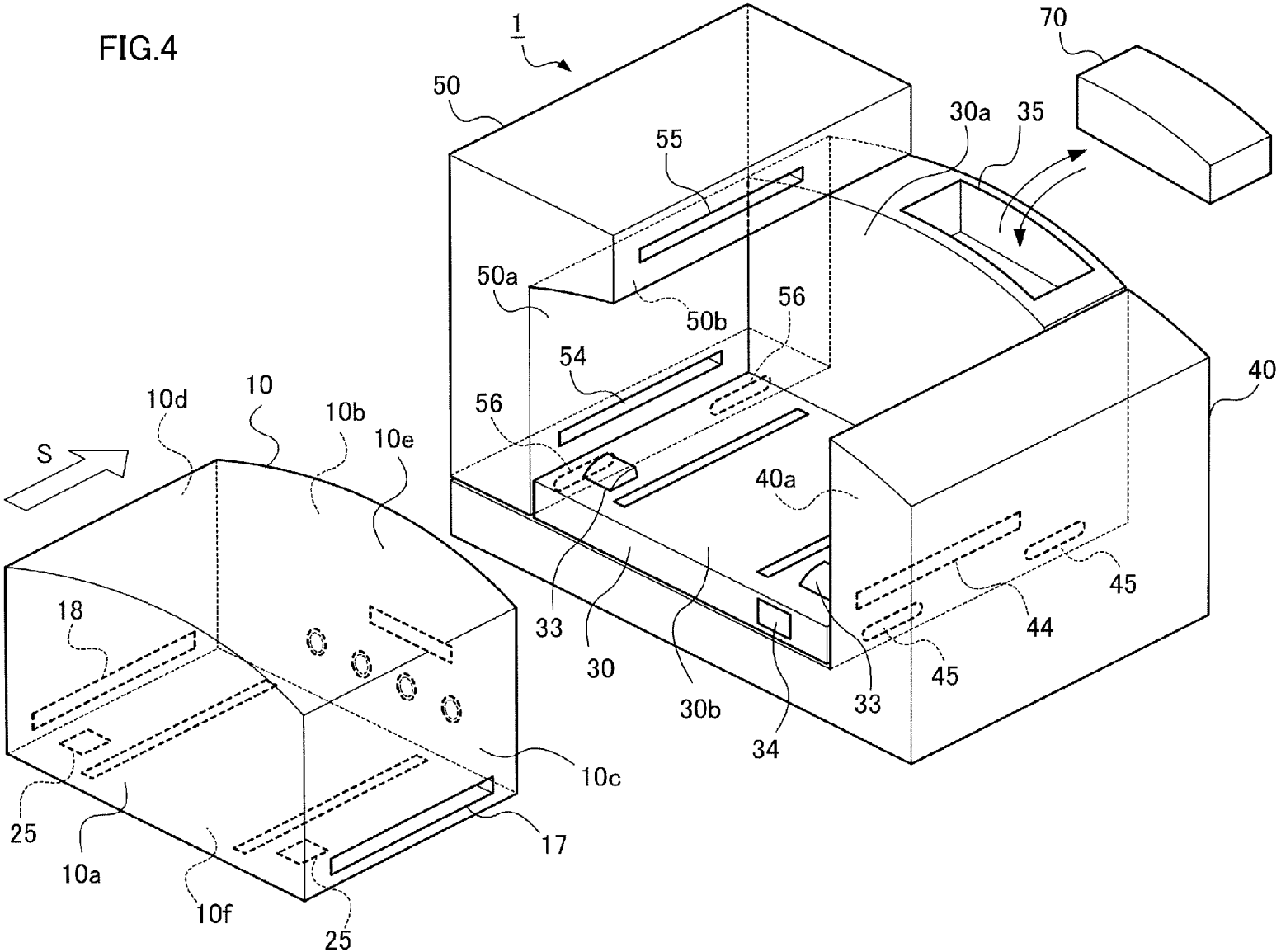
FIG. 4 is a view for illustrating an attachment configuration for the image forming apparatus not including the capturing unit and used for a printer, for example.

FIG. 4 is a view for illustrating an attachment configuration for the image forming apparatus 1 not including the capturing unit 60 and used for a printer, for example. As shown in FIG. 4, the power supply unit 30, the feeding unit 40 and the output unit 50 are attached so as to be adjacent to each other. In this state, the image forming unit 10 is not attached. By sliding in the attachment direction (arrow S direction) in FIG. 4 in the state where the power supply unit 30, the feeding unit 40 and the output unit 50 have been attached so as to be adjacent to each other, the image forming unit 10 is attachable to the image forming apparatus 1.

In the example shown in FIG. 4, an L-shaped base structure is used for the power supply unit 30 to reinforce weak structure bodies.

Attachment of the feeding unit 40 will be described.

The feeding unit 40 is attached to the power supply unit 30 in a state where an inner longitudinal surface 40*a* (see FIG. 4) of the feeding unit 40 is in contact with the one side surface (right side surface) 30*d*, shown in FIG. 2A, of the power supply unit 30 while an inner bottom surface (not shown in the figure) of the feeding unit 40 is in contact with the outer bottom surface 30*f* (see FIG. 2A) of the power supply unit 30. To fix the feeding unit 40, screws or latch mechanisms (not shown in the figure) may be used, for example. When the feeding unit 40 is attached, a connector 45 (see FIG. 4) of the feeding unit 40 is coupled with the connecter 36 (see FIG. 2A) of the power supply unit 30. Thereby, power may be supplied from the power supply unit 30 to the feeding unit 40, and electric signals may be transmitted between the units. In the example of the image forming apparatus 1 shown in FIG. 4, the feeding unit 40 forms parts of the appearance of the image forming apparatus 1, the parts corresponding to the one side surface, a part of the front surface (in the incorporation direction of the image forming unit 10), a part of the back surface opposite to the front surface, a part of the upper surface, a part of the other side surface and the bottom surface of the image forming apparatus 1.

Attachment of the output unit 50 will be described.

The output unit 50 is attached to the power supply unit 30 in a state where an inner longitudinal surface 50*a* (see FIG. 4) of the output unit 50 is in contact with the different side surface (left side surface) 30*e* and a part of the top surface 30*c* of the power supply unit 30 shown in FIG. 2A. To fix the output unit 50, screws or latch mechanisms (not shown in the figure) may be used. When the output unit 50 is attached, a connector 56 (see FIG. 4) of the output unit 50 is coupled with the connecter 37 (see FIG. 2A) of the power supply unit 30. Thereby, power is supplied from the power supply unit 30 to the output unit 50, and electric signals are transmitted between the units. In the example of the image forming apparatus 1 shown in FIG. 4, the output unit 50 forms parts of the appearance of the image forming apparatus 1, the parts corresponding to the different side surface, a part of the front surface (in the incorporation direction of the image forming unit 10), a part of the back surface opposite to the front surface and a part of the upper surface of the image forming apparatus 1.

In the example shown in FIG. 4 where the capturing unit 60 is not included, the operation unit 70 is inserted into the connection portion 35 of the power supply unit 30, to be used. In the example shown in FIG. 5 where the capturing unit 60 is attached thereto, the operation unit 70 is removed from the power supply unit 30, and the support portion 61, which is a part of the capturing unit 60, is inserted into the connection portion 35. Thereby, power is supplied from the power supply unit 30 to the capturing unit 60, and electrical signals are transmitted between the units.

When the power supply unit 30, the feeding unit 40 and the output unit 50 are thus attached, the image forming unit 10 is attached in a space formed by these structure bodies (see FIG. 4). Specifically, the image forming unit 10 is lifted by using the grip 29 (see FIG. 3), and guided by the sliding structure mechanism 38 (see FIG. 2) of the power supply unit 30. Then, a user pushes a front surface 10*a* of the image forming unit 10. Thus, the image forming unit 10 is inserted into the space. When the image forming unit 10 is inserted and reaches an attachment position, the latch structure 33 of the power supply unit 30 is fitted with the latch recess 25 of the image forming unit 10 as shown in FIG. 2B, and the image forming unit 10 is fixed by a latch operation.

When the image forming unit 10 is attached, a back surface 10*b* of the image forming unit 10 shown in FIG. 4 comes in contact with the inner longitudinal surface 30*a* of the power supply unit 30 while a one side surface 10*c* comes in contact with the inner longitudinal surface 40*a* of the feeding unit 40, thereby fixing the image forming unit 10. Moreover, a different side surface 10*d* and a part of a top surface 10*e* of the image forming unit 10 come in contact with the inner longitudinal surface 50*a* and an inner top surface 50*b* of the output unit 50, respectively, and a bottom surface 10*f* comes in contact with the inner bottom surface 30*b* of the power supply unit 30, thereby fixing the image forming unit 10. Thus, when being attached, the image forming unit 10 is in contact, at five surfaces, with other units in the example in FIG. 4, that is, at least three adjacent surfaces. Compared to the case shown in FIG. 2B where the image forming unit 10 is in contact, at two surfaces, with the power supply unit 30 and hence does not have a stable fixed state, the image forming unit 10 keeps a stable fixed state by being in contact, at at least three surfaces, with other units in the example in FIG. 4. The image forming unit 10 keeps a stable fixed state in the front, back, left and right directions by being fixed while being in contact, at three adjacent surfaces, with other units, compared to a case in which only three surfaces including the two facing side surfaces and the bottom surface are supported.

When the image forming unit 10 is attached, the sheet receiving port 17 of the image forming unit 10 faces a sheet output port 44 of the feeding unit 40. Moreover, the sheet output port 18 of the image forming unit 10 faces a sheet receiving port 54 of the output unit 50. In this way, a sheet transporting path from the feeding unit 40 to the image forming unit 10 and then from the image forming unit 10 to the output unit 50 is formed. The sheet receiving port 17 and the sheet output port 18 each have a shutter mechanism, and thereby being open when the image forming unit 10 is attached while being close when the image forming unit 10 is removed from the image forming apparatus 1. The closing of the ports when the image forming unit 10 is removed enhances the black box function of the image forming unit 10.

Here, the front surface 10*a* of the image forming unit 10 forms a front portion, which is a part of the appearance, of the image forming apparatus 1.

To remove the image forming unit 10 incorporated into the image forming apparatus 1, the latch button 34 is pressed to release the latch structure 33 from the latch recess 25 of the image forming unit 10. By pulling out the image forming unit 10 in the direction opposite to the arrow S direction while the latch structure 33 is released, the image forming unit 10 may be removed.

<Attachment Configuration for Apparatus with Scanner>

Figure 5:
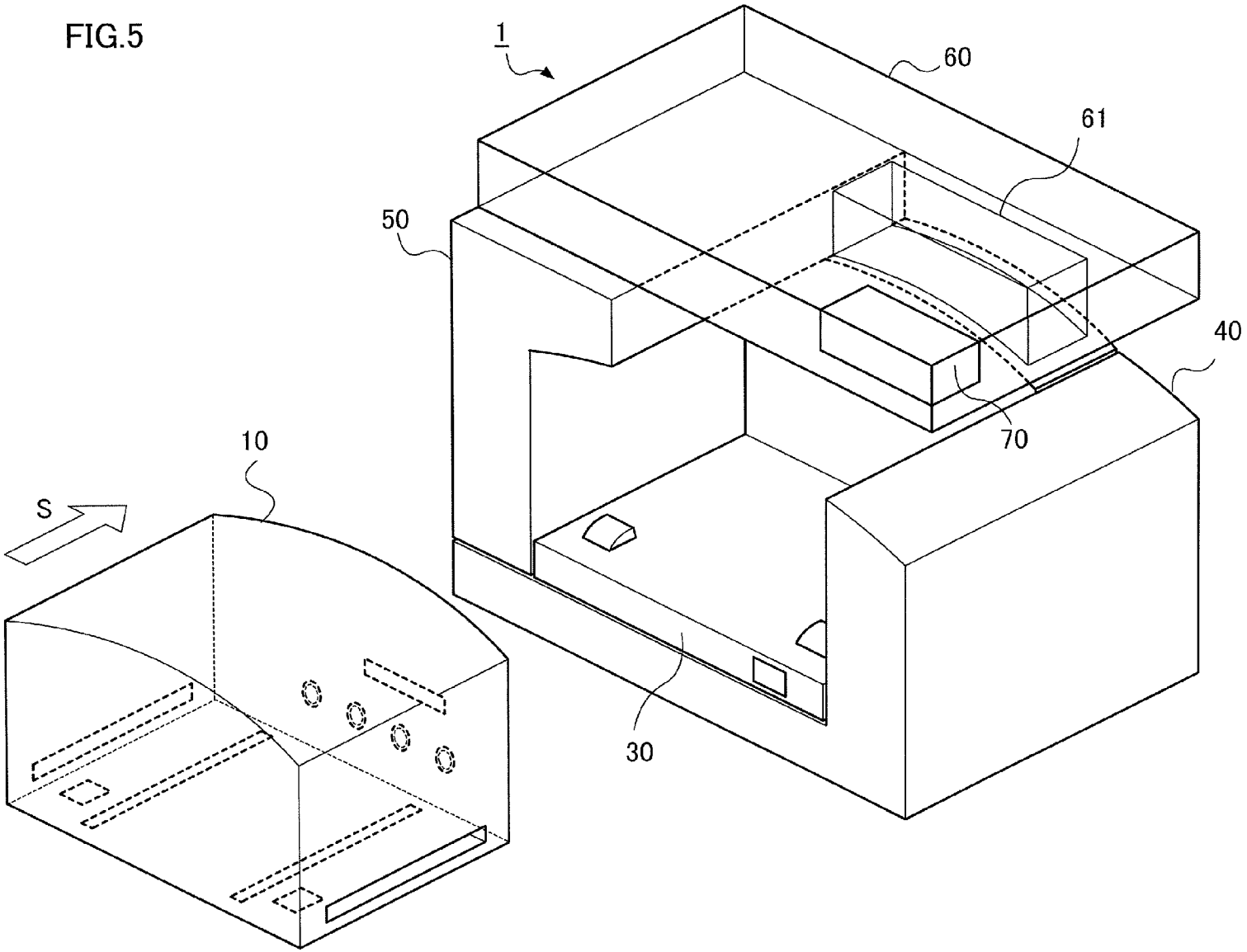
FIG. 5 is a view for illustrating an attachment configuration for the image forming apparatus including the capturing unit and used for a copy machine or a facsimile, for example.

FIG. 5 is a view for illustrating an attachment configuration for the image forming apparatus 1 including the capturing unit 60 and used for a copy machine or a facsimile, for example. In the image forming apparatus 1 shown in FIG. 5, the feeding unit 40 and the output unit 50 are attached to the power supply unit 30 as in the image forming apparatus 1 shown in FIG. 4, and the capturing unit 60 is attached to the upper parts of the power supply unit 30 and the output unit 50. Here, the operation unit 70 is removed from the connection portion 35 of the power supply unit 30 shown in FIG. 4, and a part of the support portion 61 is attached to the connection portion 35. The support portion 61 is allowed to receive power supply from the power supply unit 30 and to transmit and receive electric signals to and from the power supply unit 30, in addition to having a function as a structure member that supports the capturing unit 60. The operation unit 70 is provided to a part of the capturing unit 60.

The image forming unit 10 may be attached thereto as described with reference to FIG. 4, except that the image forming unit 10 is attached even in a state where the capturing unit 60 is further attached in addition to the units for a printer shown in FIG. 4. Specifically, the image forming unit 10 may be attached to the image forming apparatus 1 in the state where the power supply unit 30, the feeding unit 40, the output unit 50 and the capturing unit 60 are attached. In this example as well, the image forming unit 10 may be attached so as to be in contact, at at least three surfaces, with the power supply unit 30, the feeding unit 40 and the output unit 50, which are structure bodies, and to thereby keep a stable state.

<Examples of Product Configuration>

FIGS. 6A to 10 are views showing examples of a product configuration of the image forming apparatus 1. The image forming apparatus 1 to which the present exemplary embodiment is applied forms a unique range of products by combining structure bodies each forming the appearance of the image forming apparatus 1, depending on which structure bodies are chosen to be combined and how the structure bodies are combined.

Figure 6A:
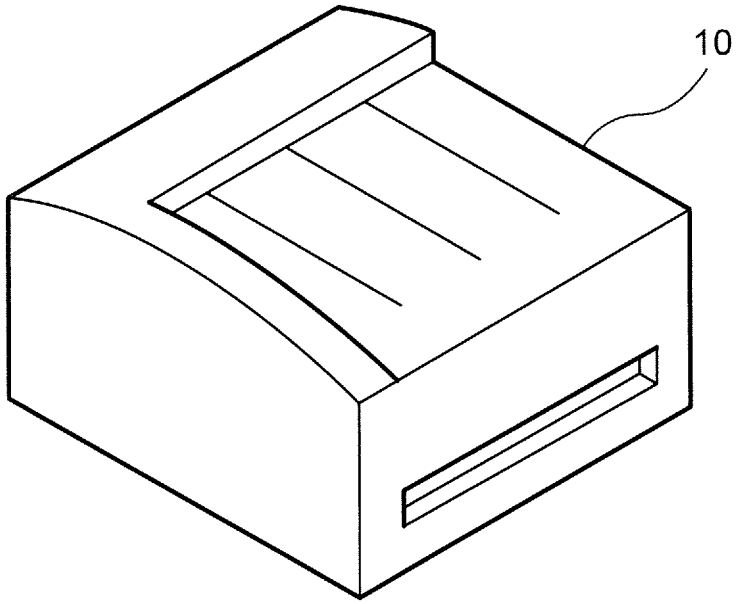
FIGS. 6A and 6B are views respectively showing the image forming unit as a single unit product and a minimum module configuration.
Figure 6B:
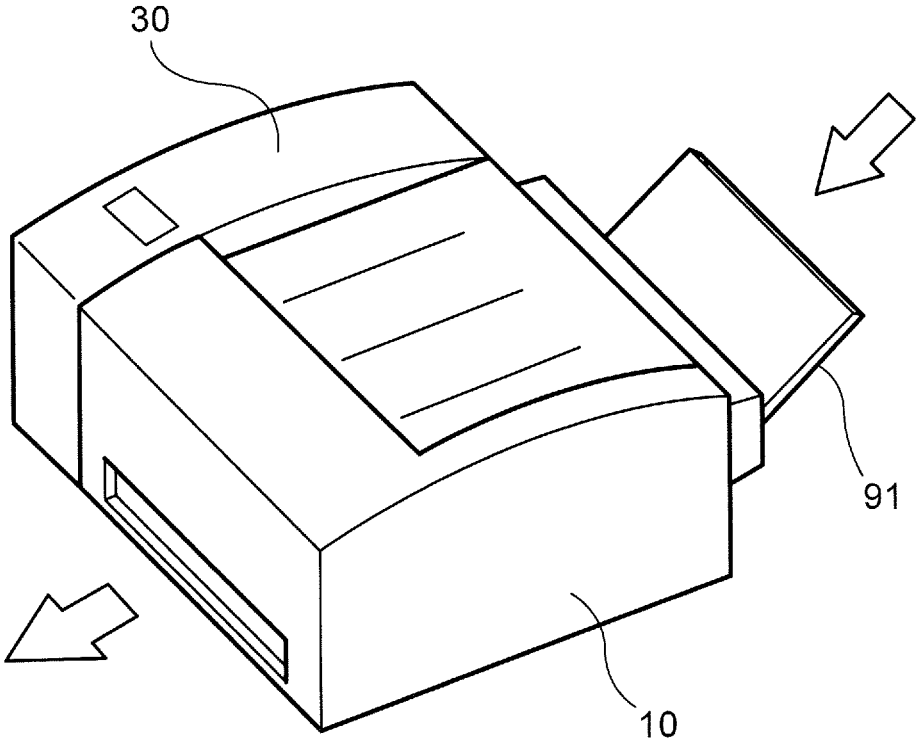

FIGS. 6A and 6B are views respectively showing the image forming unit 10 as a single unit product and a minimum module configuration. FIG. 6A shows the image forming unit 10 replaceable as a single unit. The image forming unit 10 shown in FIG. 6A is a replaceable product for the image forming apparatus 1 having a product configuration to be described later. In the related art, for example, each of the image forming portions 20 of the respective colors as a unit (see FIG. 1), that is, a so-called cassette is taken as a replaceable product. However, in the present exemplary embodiment for example, the multiple image forming portions 20 are integrally formed, and the entire image forming unit 10 forming a part of the appearance of the image forming apparatus 1 is replaced as a unit.

FIG. 6B shows a manual printer which is a product having a minimum module configuration. The manual printer has a simple attachment configuration in which the image forming unit 10 is attached to the power supply unit 30. A manual tray 91 is attached to the image forming unit 10 so as to correspond to the sheet receiving port 17 (see FIG. 2B) of the image forming unit 10, and, when sheets are placed on the manual tray 91, this configuration is used for a simple printing apparatus. The arrows in FIG. 6B indicate a sheet transporting direction. It should be noted that, in the present exemplary embodiment, the configuration shown in FIG. 6B is a module configuration as a comparative example similarly to that of a related art. This is because, in this module configuration, the image forming unit 10 serving as an image forming structure body is not in contact, at at least three surfaces, with other structure bodies, thus lacking protection required for a mechanical structure. Here, the power supply unit 30 shown in each of FIGS. 6A to 10 has a different case structure from the power supply unit 30 shown in FIG. 2A having a curved outer shape formed into an L-shape, and the power supply unit 30 shown in each of FIGS. 6A to 10 has an outer shape formed into approximately a rectangular parallelepiped.

Figure 7A:
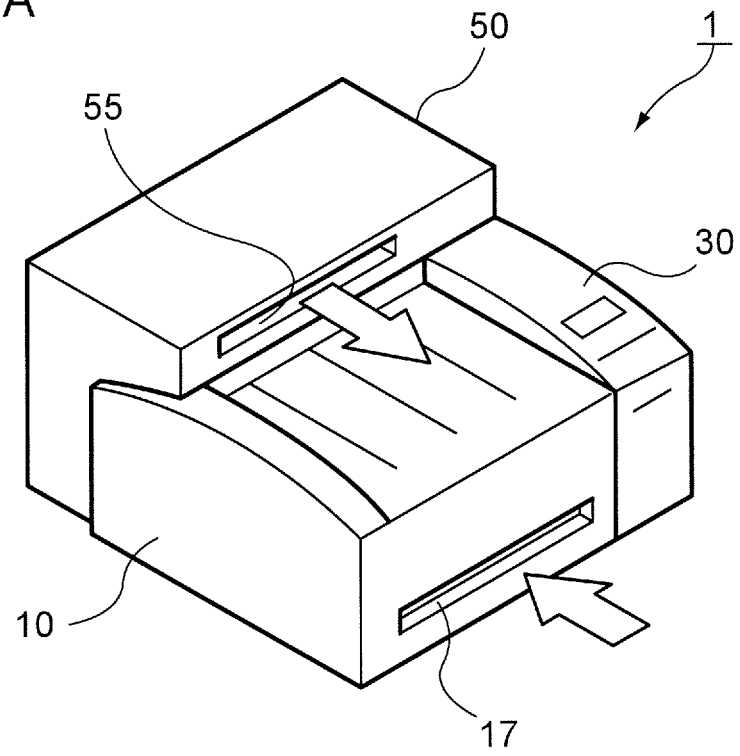
FIGS. 7A and 7B are views respectively showing a second module configuration and a third module configuration of the image forming apparatus.
Figure 7B:
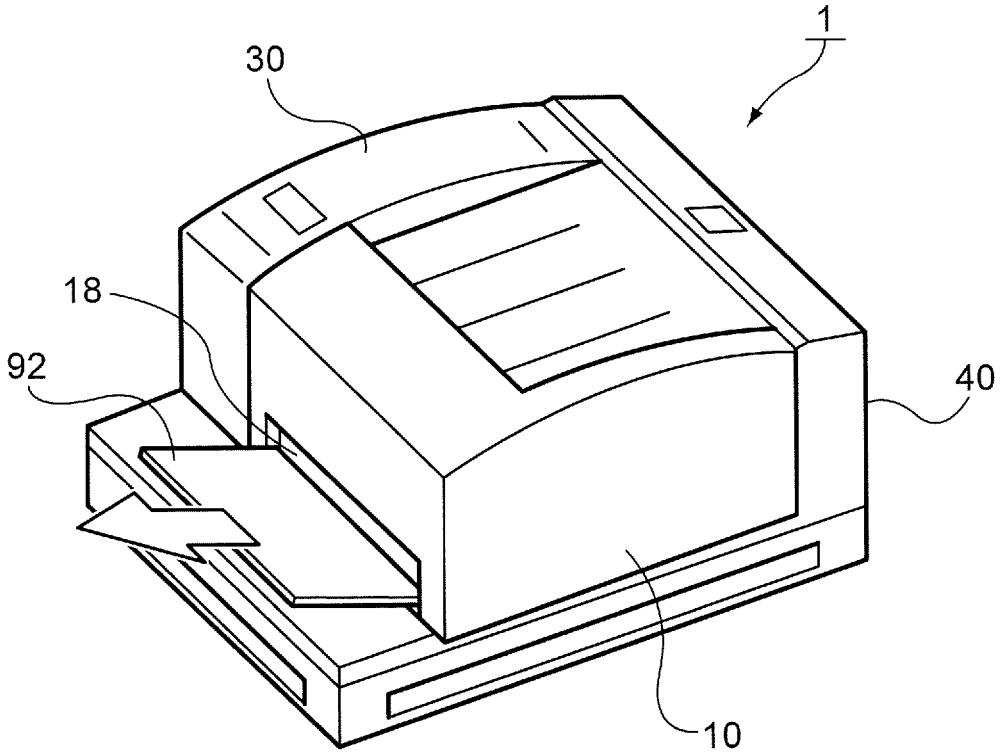

FIGS. 7A and 7B are views respectively showing a second module configuration and a third module configuration of the image forming apparatus 1.

FIG. 7A shows the second module configuration of the image forming apparatus 1. This example is a product attachment configuration formed of the image forming unit 10 as an example of an image forming structure body, the power supply unit 30 as an example of a connection structure body, and the output unit 50 as an example of an output recording medium transporting structure body. A sheet is inserted from the sheet receiving port 17 of the image forming unit 10, and the sheet subjected to image formation is outputted from the output port 55 of the output unit 50.

In the attachment configuration example shown in FIG. 7A, the image forming unit 10 is in contact, at one surface, with the power supply unit 30, and, at two surfaces (one of the side surfaces, and a part of the top surface), with the output unit 50. In other words, the image forming unit 10 is in contact, at at least three surfaces, with other structure bodies.

FIG. 7B shows the third module configuration of the image forming apparatus 1. This example is a product attachment configuration formed of the image forming unit 10 as an example of an image forming structure body, the power supply unit 30 as an example of a connection structure body, and the feeding unit 40 as an example of a recording medium transporting structure body. A sheet is fed from the sheet storing portion 41 (see FIG. 1) of the feeding unit 40 to the image forming unit 10, and the sheet subjected to image formation is outputted from the sheet output port 18 of the image forming unit 10. An exit tray 92 may be attached to the sheet output port 18 for easy handling of the outputted sheets.

In the attachment configuration example shown in FIG. 7B, the image forming unit 10 is in contact, at one surface, with the power supply unit 30, and, at two surfaces (one of the side surfaces, and the bottom surface), with the feeding unit 40. In other words, the image forming unit 10 is in contact, at at least three surfaces, with other structure bodies.

Figure 8A:
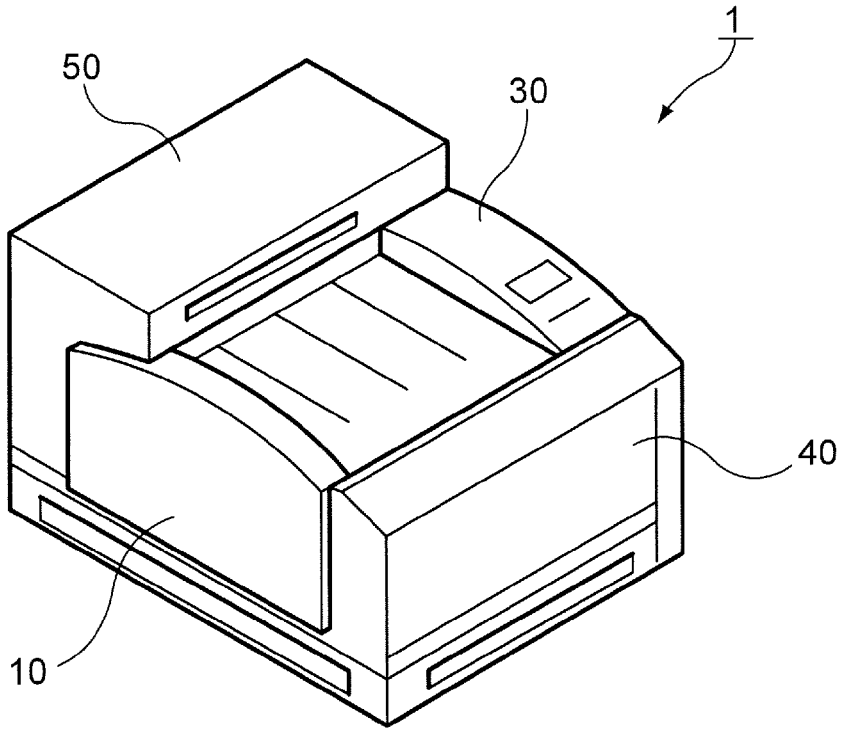
FIGS. 8A and 8B are views respectively showing a fourth module configuration and a fifth module configuration of the image forming apparatus.
Figure 8B:
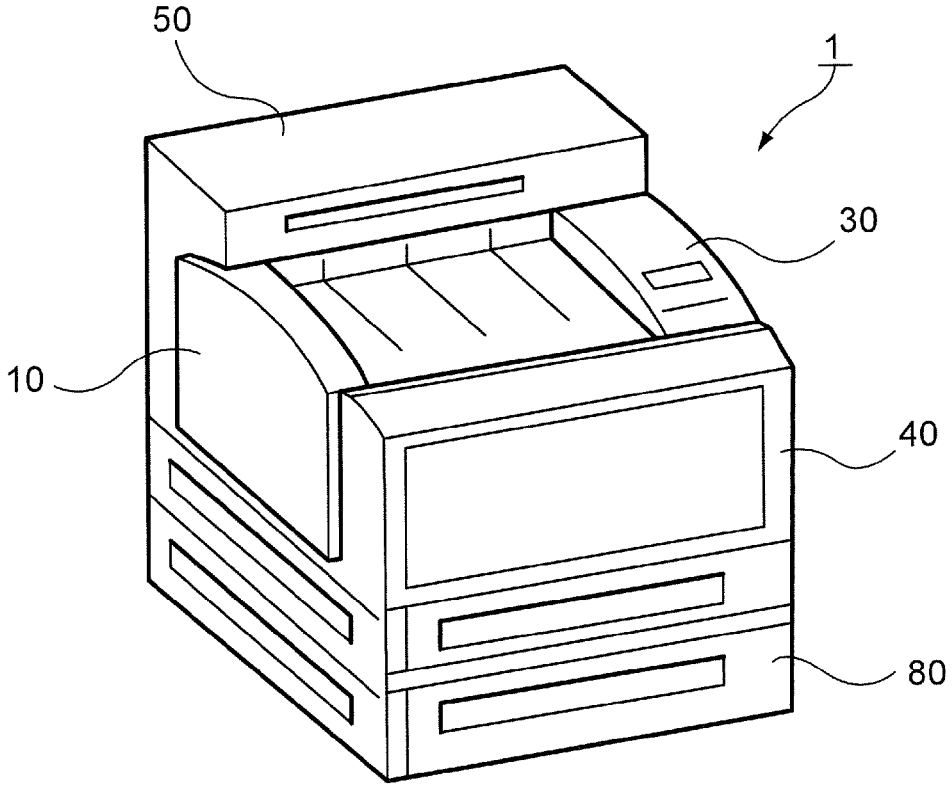

FIGS. 8A and 8B are views respectively showing a fourth module configuration and a fifth module configuration of the image forming apparatus 1.

FIG. 8A shows the fourth module configuration of the image forming apparatus 1. This example is a product attachment configuration formed of the image forming unit 10 as an example of an image forming structure body, the power supply unit 30 as an example of a connection structure body, the feeding unit 40 as an example of a recording medium transporting structure body, and the output unit 50 as an example of an output recording medium transporting structure body. In the example shown in FIG. 8A, the image forming unit 10 is in contact, at one surface, with the power supply unit 30, at two surfaces (one of the side surfaces, and the bottom surface), with the feeding unit 40, at two surfaces (another one of the side surfaces and a part of the top surface), with the output unit 50. In other words, the image forming unit 10 is in contact, at at least three surfaces (five surfaces in this example), with other structure bodies.

FIG. 8B shows the fifth module configuration of the image forming apparatus 1. This example is obtained by adding the additional feeding unit 80 to the attachment configuration shown in FIG. 8A. The relationships of the power supply unit 30, the feeding unit 40 and the output unit 50 with the image forming unit 10 are the same as those in FIG. 8A.

Figure 9A:
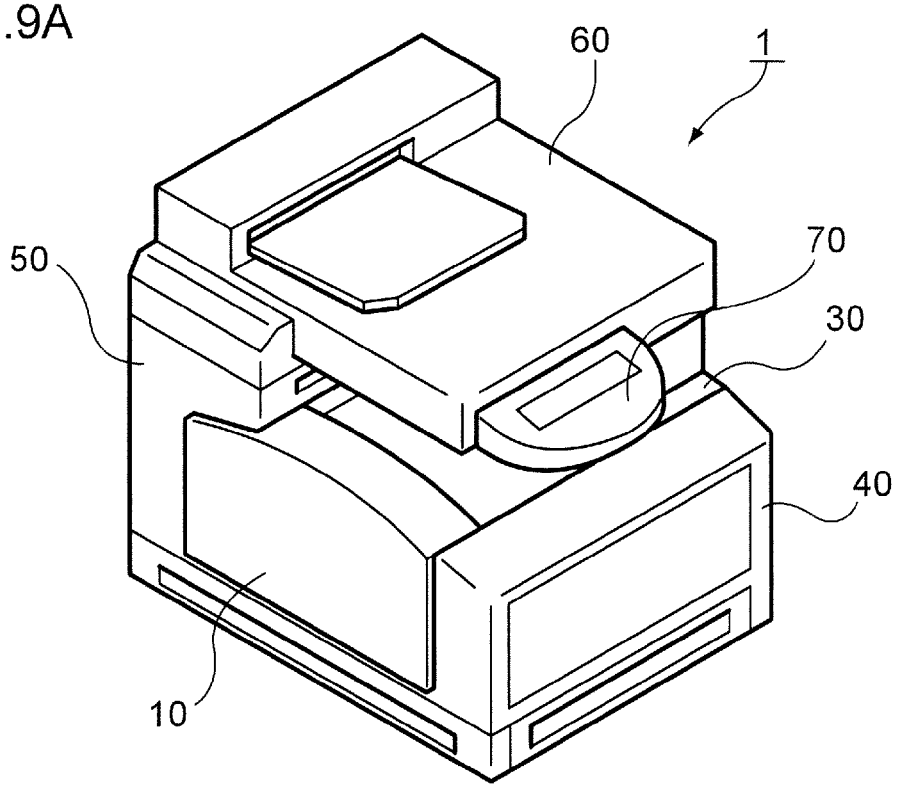
FIGS. 9A and 9B are views respectively showing a sixth module configuration and a seventh module configuration of the image forming apparatus.
Figure 9B:
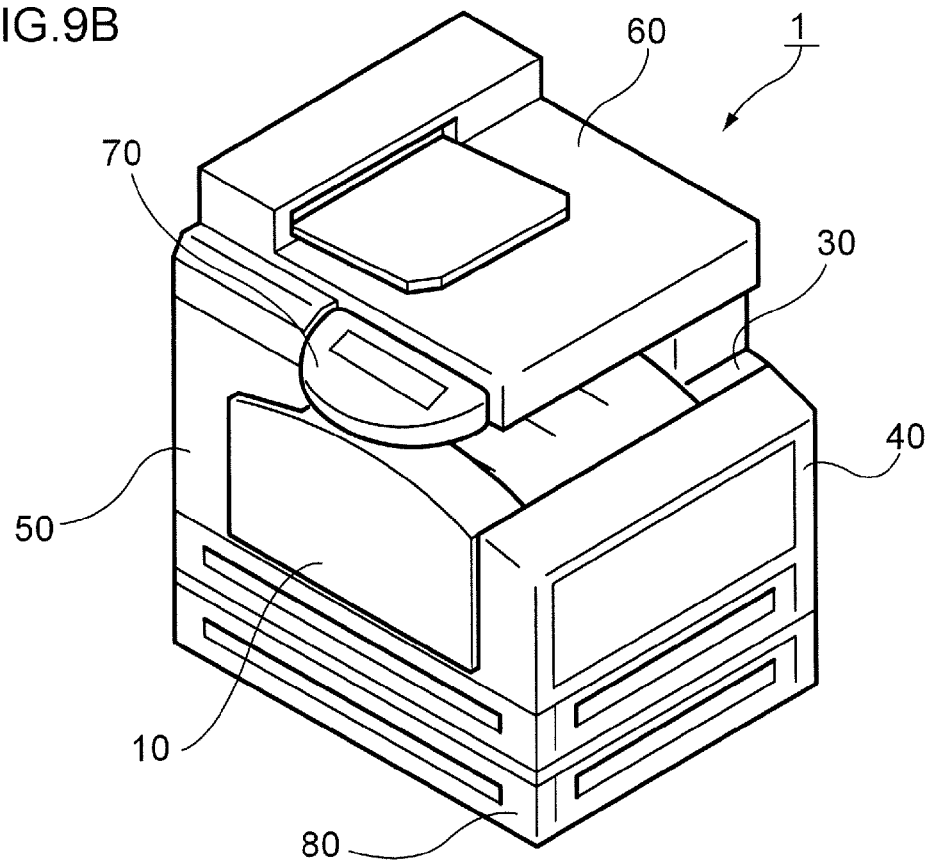

FIGS. 9A and 9B are views respectively showing a sixth module configuration and a seventh module configuration of the image forming apparatus 1.

FIG. 9A shows the sixth module configuration of the image forming apparatus 1. This example is obtained by adding the capturing unit 60, which is an image capturing structure body, to the attachment configuration shown in FIG. 8A. In addition, in FIG. 9A, the operation unit 70 is attached as an external structure of the capturing unit 60. The relationships of the power supply unit 30, the feeding unit 40 and the output unit 50 with the image forming unit 10 are the same as those in FIG. 8A.

FIG. 9B shows the seventh module configuration of the image forming apparatus 1. This example is obtained by adding the additional feeding unit 80 to the attachment configuration shown in FIG. 9A. Moreover, the operation unit 70 is attached to the capturing unit 60 in a direction different from that in FIG. 9A. The operation unit 70 is attached in a position that is selected in consideration of a direction in which a user of the image forming apparatus 1 accesses the apparatus, and that allows the user to access to the image forming apparatus 1 easily. The relationships of the power supply unit 30, the feeding unit 40 and the output unit 50 with the image forming unit 10 are the same as those in FIG. 8A.

Figure 10:
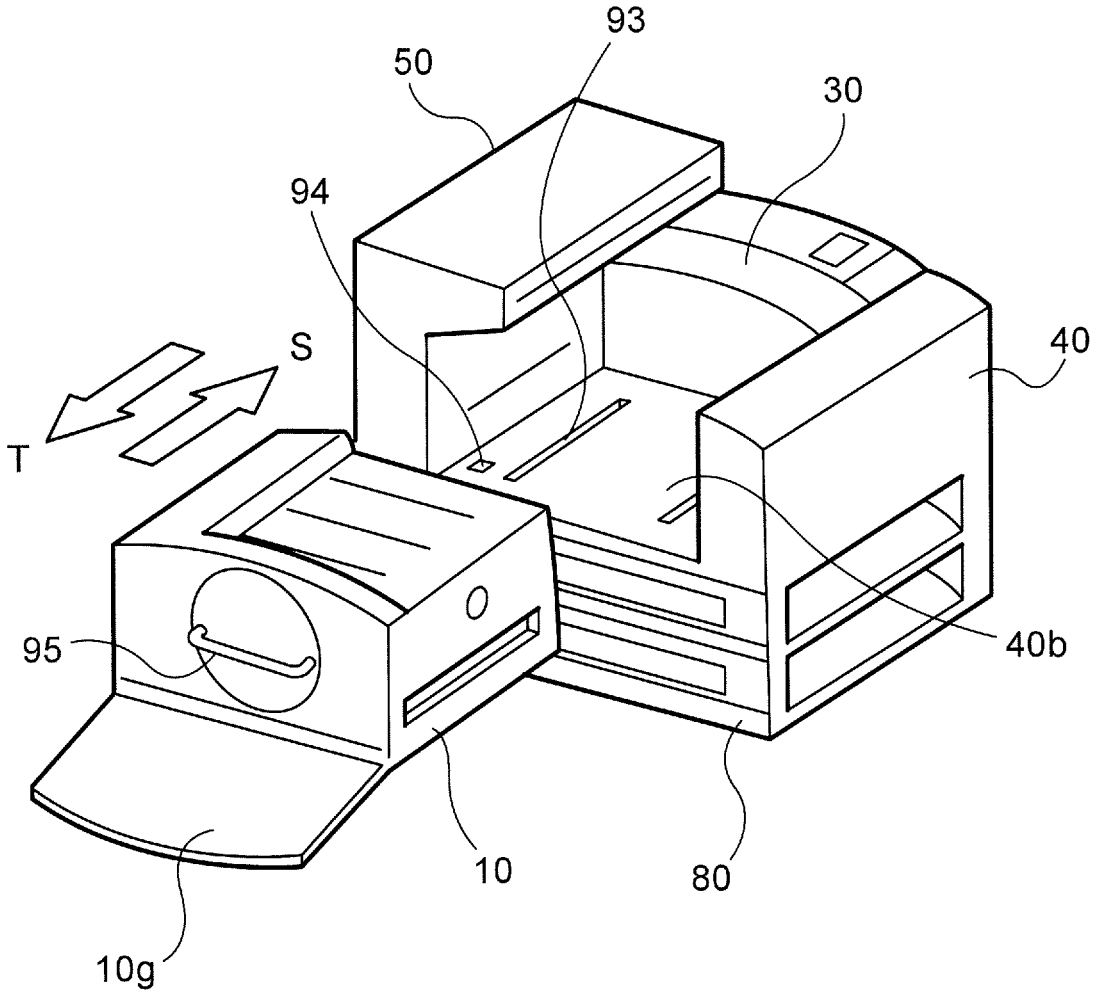
FIG. 10 is a view for illustrating attachment and removal of the image forming unit.

FIG. 10 is a view for illustrating attachment and removal of the image forming unit 10 in the configuration shown in FIG. 8B. In the examples shown in FIGS. 8A to 10, the same mechanisms as the sliding structure mechanism 38 and the latch structure 33 of the power supply unit 30 described with reference to FIG. 2A are provided on a surface 40*b* of the feeding unit 40. Specifically, on the surface 40*b*, a sliding structure mechanism 93 such as a rail mechanism, and a latch structure 94 that fixes the attached image forming unit 10 are provided. The moving mechanism 19 shown in FIG. 2B is aligned with the sliding structure mechanism 93 provided on the surface 40*b* of the feeding unit 40, and the image forming unit 10 is pushed into the attachment direction (arrow S direction) in FIG. 10, thus completing the attachment of the image forming unit 10. Hence, even in a state where the power supply unit 30, the feeding unit 40 and the output unit 50 have already been attached, the image forming unit 10 is still attachable. The same sliding structure mechanism may also be provided to the feeding unit 40 shown in FIG. 7B.

In addition, as shown in FIG. 10, the image forming unit 10 includes an inner grip 95 inside thereof behind a lid 10*g* of the image forming unit 10, the inner grip 95 appearing when the lid 10*g* is opened. A user attaches the image forming unit 10 to the surface 40*b* of the feeding unit 40 by holding the grip 29 shown in FIG. 3 and the inner grip 95. The user pushes the image forming unit 10 in the attachment direction (arrow S direction) while holding the inner grip 95, and then causes the image forming unit 10 to slide, thereby attaching the image forming unit 10 to the image forming apparatus 1. To remove the image forming unit 10, the user opens the lid 10*g* of the image forming unit 10, and then pulls out (arrow T direction) the inner grip 95 while pressing, for example, the same latch releasing mechanism (not shown in the figure) as the latch button 34 shown in FIG. 4. By this operation, the image forming unit 10 is removed from the image forming apparatus 1.

The inner grip 95 may have an interlock function. With this function, when the image forming unit 10, for example, is attached to the image forming apparatus 1, the image forming unit 10 is locked with the image forming apparatus 1, by turning the inner grip 95 in one direction. Here, the image forming apparatus 1 may be configured so as not to allow power supply to the image forming unit 10 without the locking. To remove the image forming unit 10 from the image forming apparatus 1, on the other hand, the inner grip 95 is turned to the other direction, which is a direction opposite to the one direction, to release the lock, and then the image forming unit 10 is removed. Mechanical locking may also be performed by turning the inner grip 95. Another example is to omit the latch structure 33 and the structure of the latch button 34 (see FIG. 2), when such locking using the inner grip 95 is employed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming structure body that is replaceable, that forms at least a part of an exterior of the image forming apparatus, and that includes elements for image formation;

a recording medium transporting structure body that forms at least a part of the exterior of the image forming apparatus, and that includes elements for transporting a recording medium to the image forming structure body, and a portion of recording medium transporting structure body is oriented vertically on one side of the image forming structure body;

an output recording medium transporting structure body that forms at least a part of the exterior of the image forming apparatus, and that transports, to an output port, a recording medium outputted from the image forming structure body, and a portion of the output recording medium transporting structure body is oriented vertically on an opposite side of the image forming structure body; and an L-shaped connection structure body that forms at least a part of the exterior of the image forming apparatus, and that is electrically connected to all structure bodies, and a portion of the L-shaped connection structure body is oriented horizontally between the recording medium transporting structure body and the output recording medium transporting structure body, the recording medium transporting structure body, the output recording medium transporting structure body and the L-shaped connection structure body being attached so as to be adjacent to each other, and being attachable to each other in a state where the image forming structure body is not attached, the image forming structure body being attached within a space formed by three structure bodies: the recording medium transporting structure body, the output recording medium transporting structure body and the L-shaped connection structure body in a state where the three structure bodies have been attached so as to be adjacent to each other, the image forming structure body being in contact with the three structure bodies within the space at four surfaces of the image forming structure body, and the image forming structure body being attachable in a state where the three structure bodies have been attached to each other, and the image forming structure body forming a horizontal path such that the recording medium enters and exits the image forming structure body horizontally.

2. The image forming apparatus according to claim 1, wherein the image forming structure body is attachable by making the image forming structure body move in a sliding direction with respect to an upper surface of any one of the L-shaped connection structure body and the recording medium transporting structure body.

3. The image forming apparatus according to claim 1, wherein the image forming structure body includes, in an upper surface of appearance of the image forming structure body, an output recording medium tray on which a recording medium to be outputted after image formation is placed.

4. The image forming apparatus according to claim 1, wherein the image forming structure body includes a grip in an upper surface of the exterior of the image forming structure body, the grip used for lifting the image forming structure body, and the grip has any one of a configuration and a location so that transportation of a recording medium to be outputted is not hindered.

5. The image forming apparatus according to claim 1, further comprising an image capturing structure body that forms at least a part of the exterior of the image forming apparatus, and captures an image, wherein the image capturing structure body is electrically connected to and is attached to the L-shaped connection structure body by removing a user operation structure body attached to the L-shaped connection structure body and attaching a part of the image capturing structure body in place of the removed user operation structure body.

6. The image forming apparatus according to claim 1, wherein the image forming structure body includes a plurality of image forming portions each including the image carrier, the charging portion and the developing portion, and the image forming structure body is formed as a single structure body including portions from an alignment mechanism that aligns a transported recording medium for image formation and a fixing portion that fixes an image to a recording medium.

7. An image forming apparatus comprising:

an image forming structure body that is replaceable, that forms at least a part of an exterior of the image forming apparatus, and that includes elements for image formation;

a recording medium transporting structure body that forms at least a part of the exterior of the image forming apparatus and that includes elements for transporting a recording medium to the image forming structure body, and a portion of the recording medium transporting structure body is oriented vertically on one side of the image forming structure body;

an output recording medium transporting structure body that forms at least a part of the exterior of the image forming apparatus and that transports, to an output port, a recording medium outputted from the image forming structure body, and a portion of the output recording medium transporting structure body is oriented vertically on an opposite side of the image forming structure body; and an L-shaped connection structure body that forms at least a part of the exterior of the image forming apparatus, and that is electrically connected to all structure bodies, and a portion of the L-shaped connection structure body is oriented horizontally between the recording medium transporting structure body and the output recording medium transporting structure body, the L-shaped connection structure body and at least any one of the recording medium transporting structure body and the output recording medium transporting structure body being attachable to each other in a state where the image forming structure body is not attached, wherein in a state where the L-shaped connection structure body and at least any one of the recording medium transporting structure body and the output recording medium transporting structure body have been adjacently attached to each other, the image forming structure body is attached within a space formed by two adjacent surfaces of the L-shaped connection structure body and two surfaces of the recording medium transporting structure body and the output recording medium transporting structure body, or a space formed by two adjacent surfaces of the L-shaped connection structure body and one surface of any one of the recording medium transporting structure body and the output recording medium transporting structure body, and is in contact with the L-shaped connection structure body and at least any one of the recording medium transporting structure body and the output recording medium transporting structure body at three adjacent surfaces of the image forming structure body, and the image forming structure body is attachable in a state where the L-shaped connection structure body and at least any one of the recording medium transporting structure body and the output recording medium transporting structure body have been attached to each other, and the image forming structure body forming a horizontal path such that the recording medium enters and exits the image forming structure body horizontally.

8. The image forming apparatus according to claim 7, wherein the image forming structure body does not include any drive source and becomes drivable by being connected to a drive source when the image forming structure body is attached to the image forming apparatus.

9. The image forming apparatus according to claim 7, wherein the image forming structure body includes, as the elements for image formation, a plurality of image forming portions each including an image carrier, a charging portion and a developing portion, and a fixing portion that fixes an image onto a recording medium, and the image forming structure body is formed as a single structure body including portions from an alignment mechanism that aligns a transported recording medium for image formation, and the image forming structure body is selected from a plurality of image forming structure bodies having different types of the image forming portions, and is incorporated into the image forming apparatus.

10. An attachment method for an image forming apparatus including an image forming structure body that is replaceable, that forms at least a part of an exterior of the image forming apparatus, and that includes elements for image formation; a recording medium transporting structure body that forms at least a part of the exterior of the image forming apparatus, and that includes elements for transporting a recording medium to the image forming structure body; an output recording medium transporting structure body that forms at least a part of the exterior of the image forming apparatus, and that transports, to an output port, the recording medium outputted from the image forming structure body; and a connection structure body that forms at least a part of the exterior of the image forming apparatus, and that is electrically connected to structure bodies, the attachment method comprising:

attaching the recording medium transporting structure body, the output recording medium transporting structure body and the connection structure body so as to be adjacent to each other before the image forming structure body is attached; and attaching the image forming structure body within a space formed by the recording medium transporting structure body, the output recording medium transporting structure body and the connection structure body, which acts as three structure bodies, in a state where the three structure bodies have been attached so as to be adjacent to each other, and to be in contact with the three structure bodies within the space at four surfaces of the image forming structure body, wherein two of the four surfaces of the image forming structure body respectively contact two adjacent surfaces of the connection structure body, and the image forming structure body forming a horizontal path such that the recording medium enters and exits the image forming structure body horizontally.

11. The image forming apparatus according to claim 10, wherein the image forming structure body is attached within the space formed by the three structure bodies: the recording medium transporting structure body, the output recording medium transporting structure body and the connection structure body in a state where the three structure bodies have been attached so as to be adjacent to each other, and the image forming structure body is in contact with the three structure bodies within the space at least four surfaces of the image forming structure body including three side surfaces of the image forming structure body.

12. The image forming apparatus according to claim 10, wherein the connection structure body is L-shaped and has a bottom surface and a back surface defining the space, the bottom surface and the back surface being the two adjacent surfaces of the connection structure body, and the two of the four adjacent surfaces of the image forming structure body respectively contacting the bottom surface and the back surface.

* * * * *